US006609319B1

(12) United States Patent
Olson

(10) Patent No.: US 6,609,319 B1
(45) Date of Patent: Aug. 26, 2003

(54) BOLT ASSEMBLIES FOR FIREARMS

(75) Inventor: Douglas D. Olson, Vero Beach, FL (US)

(73) Assignee: Knights Armament Company, Vero Beach, FL (US)

( * ) Notice: Subject to any disclaimer, the term of this patent is extended or adjusted under 35 U.S.C. 154(b) by 0 days.

(21) Appl. No.: 10/265,638

(22) Filed: Oct. 7, 2002

(51) Int. Cl.[7] ..... F41A 3/00

(52) U.S. Cl. ..... 42/16; 42/18; 42/19; 89/185; 89/187.01

(58) Field of Search ..... 42/16, 17, 18, 42/19; 89/180, 181, 187.01, 187.02, 185

(56) References Cited

U.S. PATENT DOCUMENTS 4,579,034 A * 4/1986 Holloway ..... 89/33.1

6,182,389 B1 * 2/2001 Lewis ..... 42/16

* cited by examiner

*Primary Examiner*—J. Woodrow Eldred
(74) *Attorney, Agent, or Firm*—Carroll F. Palmer

(57) ABSTRACT

New and improved bolt assemblies for M4/M16 firearms capable of firing a remarkably greater number of rounds than previously available M4/M16 firearms are, disclosed that have right and left compression springs that are parallel to each other, straddle the firing pin bore and are retained in partial bores that have proximal and distal ramps descending from their open ends. Additionally, these bolt assemblies advantageously (A) have the extractor pivot pin receiving lug is positioned at the longitudinal center of the mass of the extractor, (B) walls of bolt lugs on the firearm bolt are angled tangent to full radius fillets joining adjacent bolt lugs, (C) the extractor contains a ceramic ball and a captive rubber spring to bias such ball against the extractor pivot pin to retain it in the receiving lug and (D) lugs on the barrel extension are angled tangent to substantial radius fillets joining them.

12 Claims, 9 Drawing Sheets

BOLT ASSEMBLIES FOR FIREARMS

BACKGROUND OF THE INVENTION

1. Field of the Invention

This application relates broadly to bolt assemblies for firearms. More particularly, it concerns an improved form of bolt assemblies for M4/M16 military automatic and semi-automatic firearms.

2. Description of the Prior Art

The ubiquitous M4/M16 firearms are based on a gas-operated bolt assembly that includes a multi-lug bolt and a robust barrel extension with which the bolt locks and unlocks in firing each round of ammunition. The bolt assembly also includes an elongated firing pin, a spring-loaded ejector and a spring-loaded extractor configured to releasably engage a cartridge as it is placed in the firing chamber, opened up by the forward motion of the bolt just before it rotates to lock. Thus, when the rifle is fired, the interlocked bolt receives a recoil force that is transmitted from the face of the bolt to its lugs. The lugs in turn transmit the recoil force to corresponding lugs of the barrel extension. Gas impinges between the bolt and bolt carrier forcing the bolt carrier to the rear. A cam in the bolt carrier causes the bolt to unlock from the barrel extension and open up the firing chamber. As the bolt thus travels rearward, the extractor pulls the expended cartridge from the firing chamber. The cartridge is then ejected allowing chambering of another round by the bolt assembly. This process is repeated as controlled by the firearm trigger until the last cartridge in the magazine is expended.

It is well known by the U.S. Military and the military of other countries that the bolt assemblies of M4/M16 firearms are subject to failures due to the extreme stresses and temperatures to which they are subjected during use, particularly the carbine models. Those skilled in the art have described such deficiencies and proposed solutions, e.g., see U.S. Pat. No. 6,182,389 and prior art cited therein which are incorporated herein by reference. In summary, these deficiencies are (a) breakage of the bolt lugs that engage the barrel extension, (b) breakage of the bolt at the cam pin hole, (c) malfunction of the extractor causing jamming of the firearm due to a spent cartridge remaining in the firing chamber, (d) failure of the springs that bias the extractor into cartridge engagement, (e) accumulation of trash particles on the bolt face beside the ejector and under the extractor, (f) misfirings caused by the firing pin and (g) insufficient strength in the bolt per se to sustain the extreme forces to which it is subjected.

The present invention overcomes these known deficiencies in the prior known bolt assemblies of M4/M16 firearms thereby providing new and improved bolt assemblies capable of firing a remarkably greater number of rounds than previously available M4/M16 firearms.

OBJECTS

A principal object of the invention is the provision of improved bolt assemblies for M4/M16 automatic and semi-automatic firearms.

A further object is the provision of an improved form of bolt assemblies for M4/M16 firearms that have greater service life, fewer extraction problems and an overall improvement in the reliability of the weapons that contain them.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique improvements of prior known M4/M16 firearms that comprise:

(a) a bolt defined by a proximal end, a distal end terminating in a bolt face surrounded by an integral bolt head and an integral cylindrical portion disposed between the proximal end and the distal end along a longitudinal axis, the bolt head having a plurality of bolt lugs with walls extending integrally and radially outwardly thereof and a firing pin bore concentrically disposed in the bolt along the longitudinal axis, (b) an extractor defined by a proximal end, a distal end and an integral central section comprising a dependent pivot pin receiving lug, (c) a longitudinal opening in the integral cylindrical portion to receive the extractor, (d) a proximal ledge portion within the longitudinal opening, (e) an extractor pivot pin coupling the pivot pin receiving lug into the opening, (f) a pair of right and left springs that bias the extractor distal end toward the bolt face, (g) a firing pin reciprocally carried in the firing pin bore, (h) a cam pin carried in a transverse bore in the integral cylindrical portion and retained therein by the firing pin extending through a transverse bore in the cam pin and (i) a barrel extension defined by a proximal end, a distal end, an integral central portion and a plurality of barrel extension lugs extending integrally and radially inwardly of the barrel extension distal end to operatively engage the bolt lugs.

A first unique improvement provided by the invention is an improved extractor comprising a proximal end, a right integral lateral lug portion defining a right partial bore that receives the right spring, a left integral lateral lug portion defining a left partial bore that receives the left spring. The right and left partial bores (a) are parallel to each other, (b) comprise proximal and distal vertical ramp portions and (c) are transversely spaced so they straddle the firing pin. This paired spring configuration that straddles the firing pin substantially increases the extractor force applied to the cartridge for extraction with less spring stress. In turn, this spring configuration allows the springs to function for a much longer service life.

A second unique improvement is an improved extractor having its pivot pin receiving lug positioned at the longitudinal center of the mass of the extractor. This reduces the tendency for the rotation of the bolt to release the extractor's grip on the cartridge case and increases the force applied by the springs in extracting cartridges.

A third unique improvement is an improved extractor having detent means to secure the extractor pivot pin in the pivot pin receiving lug and especially such a detent that comprises a ceramic ball and captive spring means to bias the ball against the extractor pivot pin. The means provides position retention of the pivot pin in the receiving lug and the combination of a ceramic ball with a rubber spring provides significantly greater force applied against the detent ball than can be achieved with a steel compression spring of the same volume.

A fourth unique improvement is that the walls of the bolt lugs are angled tangent to full radius fillets joining adjacent bolt lugs. This provides much greater strength to the lugs at their base connection to the bolt head while greatly reducing cracking and adding remarkable increase to bolt life.

A fifth unique improvement is providing that the bolt head junction with the integral cylindrical portion of the bolt is rebate filleted. This provides a larger radius at the intersection of the bolt face with the bolt head and provides a unique "trash groove" to prevent particles from binding the ejector.

A sixth unique improvement is the provision of a bolt face that has a circular periphery. This increases useable life of the bolt assembly and reduces the amount of trash that is pushed past the bolt face under the extractor.

A seventh unique improvement is having the walls of the barrel extension lugs angled tangent to substantial radius fillets joining adjacent barrel extension lugs. This makes these lugs stronger and remarkably reduces the tendency of them to fail.

An eight unique improvement is the provision of a firing pin that has a diameter of between 0.116 and 0.117 inches along its portion that extends through said cam pin. This smaller firing pin diameter of the pin's center portion allows the twin extractor springs to vertically clear. The firing pin mass is also reduced as compared with those used in accordance with the prior art to thereby reduce the available energy that causes the pin to mark the primer as the firearm chambers the round. The smaller firing pin enables the diameter of the cam pin also to be reduced. The smaller diameter cam pin allows the bolt to become stronger at the point that the cam pin receiving hole is placed in the bolt. This was an original source of bolt failures for prior known M4/M16 type firearms. In addition to reducing the diameter of the cam pin, the invention also adds a step in the cam pin that terminates in a partial spherical surface. This surface provides a stop for the cam pin to limit its travel into the bolt. The prior known M6 bolts had two stake marks pushed into them that reduced the diameter of the cam pin hole. This displaced material prevents the bolt from being assembled into the weapon incorrectly. The bolt assemblies of the present invention accomplish the same function, but provide a good transition point for the cam pin to interface with the bolt without creating any stress risers.

BRIEF DESCRIPTION OF THE DRAWINGS

A more complete understanding of the invention can be obtained by reference to the accompanying drawings wherein generic parts of the illustrated matter are indicated by arrowhead lines associated with the designation numerals while specific parts are indicated by plain lines and wherein.

DESCRIPTION OF THE PREFERRED EMBODIMENTS

Figure 1:
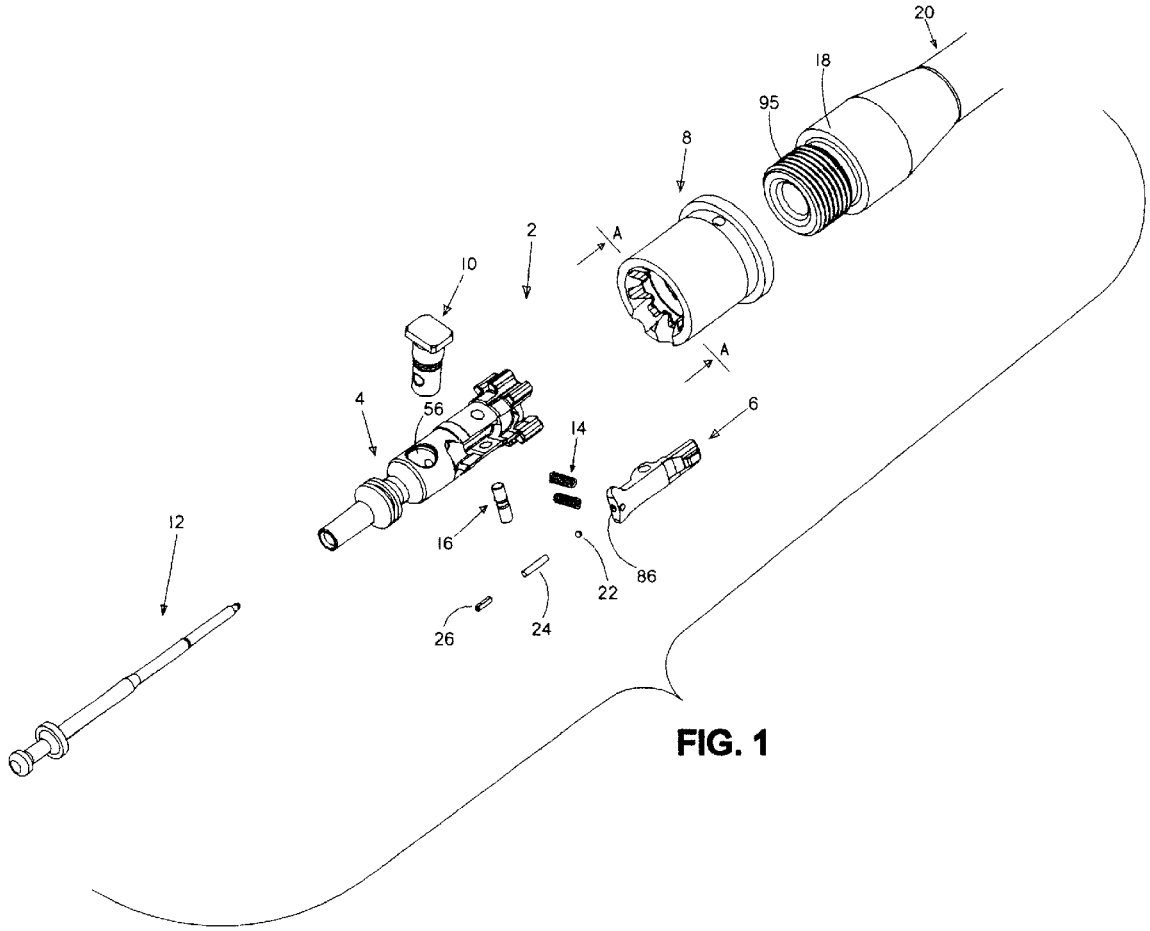
FIG. 1 is an exploded fragmented isometric view of a bolt assembly in accordance with the invention also showing a portion of a firearm barrel to which it connects.

Referring in detail to FIG. 1 of the drawings, the bolt assembly 2 of the invention comprises bolt 4, extractor 6, barrel extension 8, cam pin 10, firing pin 12, extractor springs 14 and extractor pivot pin 16. The bolt assembly 2 threads onto the rear end 18 of firearm barrel 20. Also shown are detent ball 22, detent spring 24 and compression lock 26.

Figure 2:
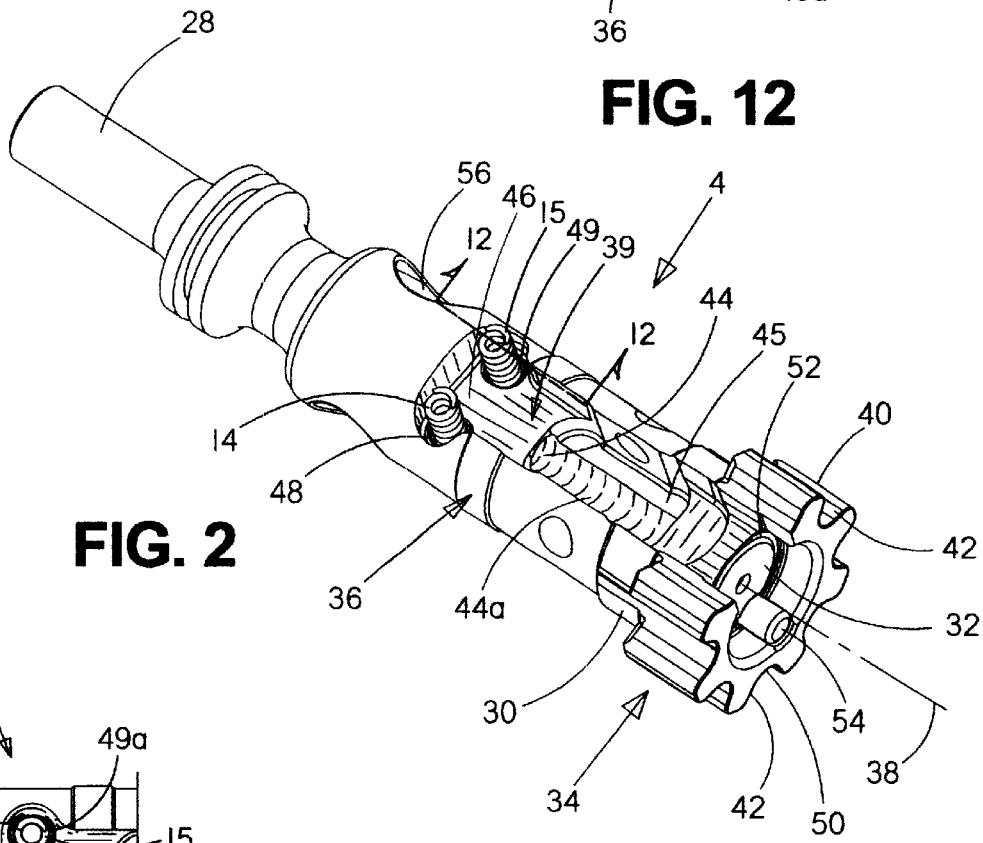
FIG. 2 is an enlarged isometric view of the bolt of the bolt assembly shown in FIG. 1.

Referring to FIG. 2, bolt 4 has a proximal end 28, a distal end 30 terminating, in a bolt face 32 surrounded by an integral bolt head 34 and an integral cylindrical portion 36 disposed between the proximal end 28 and the distal end 30 along a longitudinal axis 38. Also, there is a longitudinal opening 39 in the integral cylindrical portion 36 to receive the extractor 6 (not shown in FIG.2).

The bolt head 34 has a plurality of bolt lugs 40 with walls 42 extending integrally and radially outwardly thereof. A firing pin bore 44 is concentrically disposed in the bolt 4 along the longitudinal axis 38 and a portion 44*a* of the bore 44 is semi-circular along the base 45 of the longitudinal opening 39.

Figure 12:
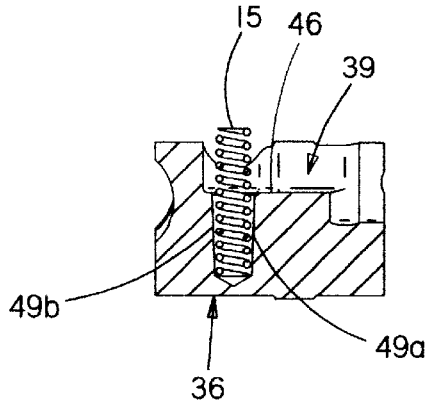
FIG. 12 is a fragmented sectional view taken on the line 12—12 of FIG. 2.
Figure 13:
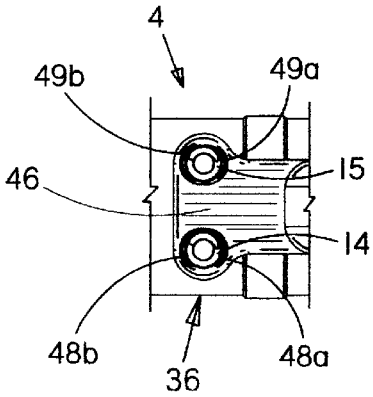
FIG. 13 is a plan view of the fragment of the new bolt assembly shown in FIG. 12.

With reference to FIGS. 12 & 13, the proximal ledge portion 46 of longitudinal opening 39 comprises a right integral lateral lug portion defining a right partial bore 48 that receives right spring 14 and a left integral lateral lug portion defining a left partial bore 49 that receives left spring 15. The right and left partial bores 48 & 49 are parallel to each other and are transversely spaced so they straddle firing pin bore 44. Also, right partial bore 48 has a proximal ramp 48*b* and a distal ramp 48*a* and left partial bore 49 has a proximal ramp 49*b* and a distal ramp 49*a*. As shown in FIG. 12, the ramps 49*a* and 49*b* are opposed mirror images whereby the open end of partial bore 49 is elliptical in shape with its major axis parallel to the longitudinal axis 38 and the closed end is circular in shape. The shape of partial bore 48 replicates partial bore 49.

The walls 42 of the bolt lugs 40 are angled tangent to full radius fillets 50 joining adjacent bolt lugs 40. Also, the bolt face 32 has a circular periphery 52 and the ejector 54 is spring biased to move distally through the bolt face 32.

The integral cylindrical portion 36 has a transverse through bore 56 to chamber the cam pin 10 (not shown in FIG.2).

Figure 3:
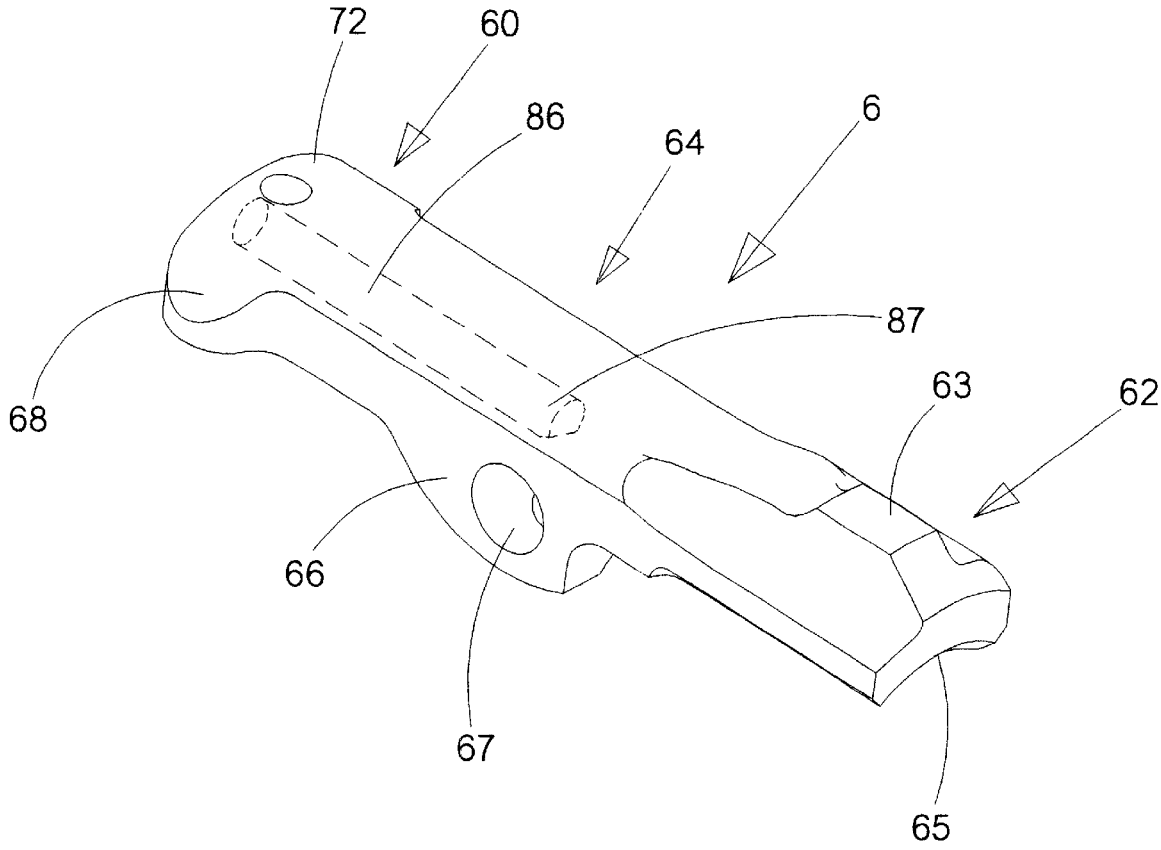
FIG. 3 is an enlarged isometric view of the extractor of the bolt assembly shown in FIG. 1 viewed from above.
Figure 4:
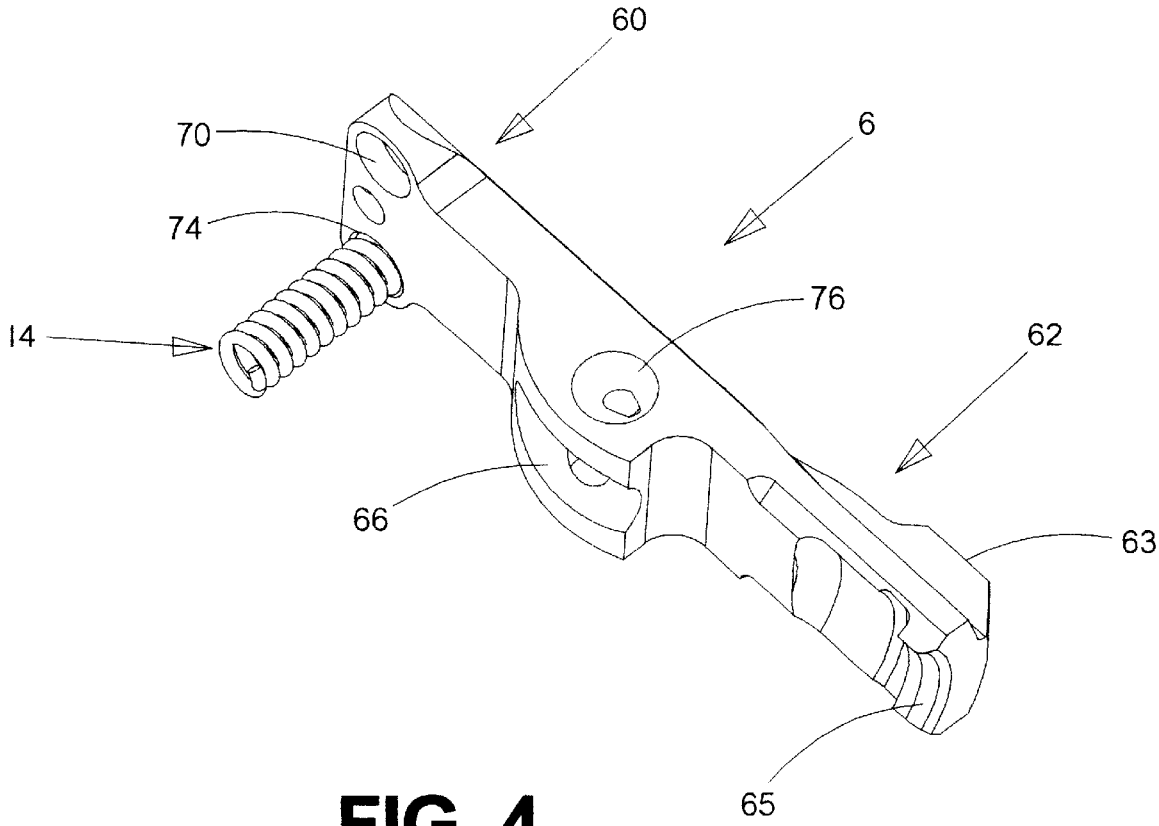
FIG. 4 is an enlarged isometric view of the extractor of the bolt assembly shown in FIG. 1 viewed from below.

Referring to FIGS. 3 & 4, the extractor 6 is defined by a proximal end 60, a distal end 62 and an integral central section 64 comprising a dependent pivot pin receiving lug 66 with a transverse bore 67. Distal end 62 bears a guide flange 63 and lip 65.

The extractor proximal end 60 comprises a right integral lateral lug portion 68 defining an inwardly facing right partial bore 70 that receives a right spring 14 and a left integral lateral lug portion 72 defining an inwardly facing left partial bore 74 that receives a left spring 14. The right partial bore 70 and left partial bore 74 are transversely spaced so the right spring (not shown) and left spring 14 straddle the firing pin bore 44 as they depend from the extractor 6 normal to the longitudinal axis 38.

Figure 5:
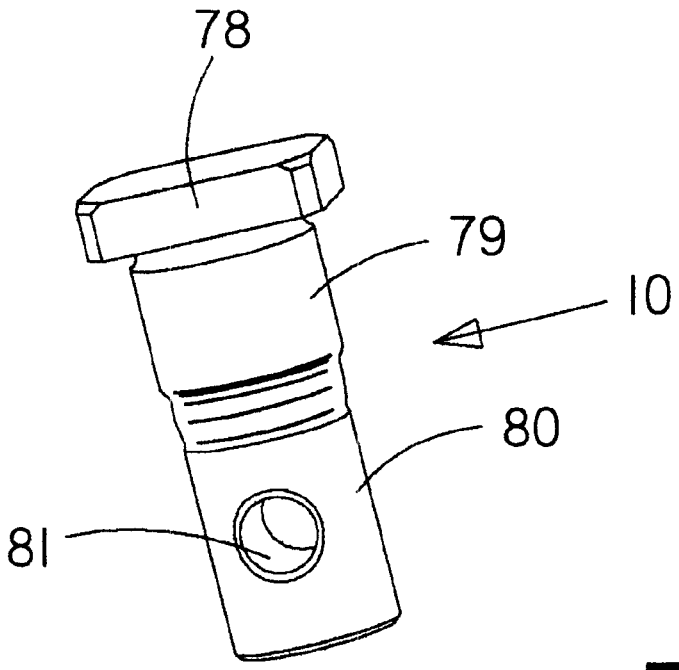
FIG. 5 is an enlarged isometric view of the cam pin of the bolt assembly shown in FIG. 1.

Referring to FIG. 5, the cam pin 10 comprises an outer square end 78, a central thrust portion 79 and an inner cylindrical end 80 with a transverse bore 81. In the bolt assembly 2, the bore 56 carries cam pin 10.

Figure 6:
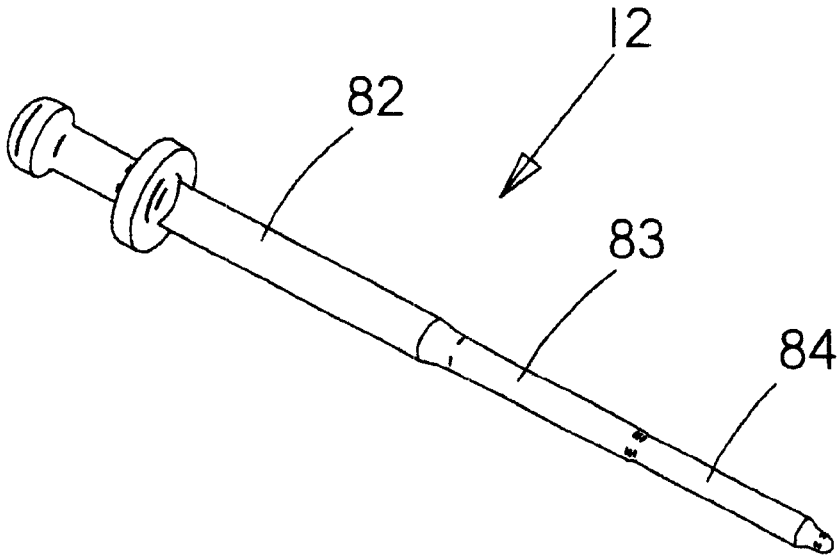
FIG. 6 is an enlarged isometric view of the firing pin of the bolt assembly shown in FIG. 1.

Referring to FIG. 6, the firing pin 12 is reciprocally carried in firing pin bore 44. It has three tiered sections 82, 83 & 84 of descending diameters. In the bolt assembly 2, the section 83 always extends through the transverse bore 81 of cam pin 10 and has a diameter of between 0.116 and 0.117 inches.

Figure 7:
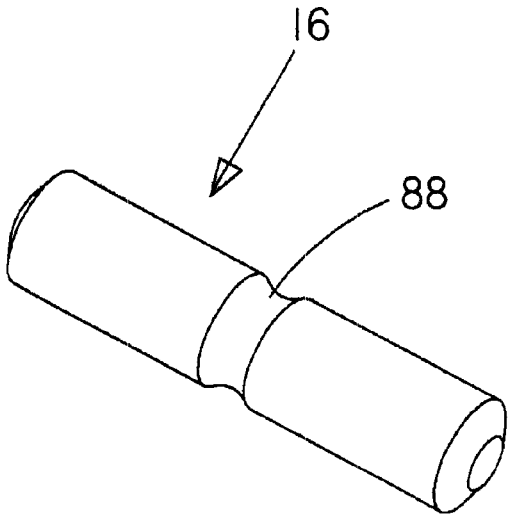
FIG. 7 is an enlarged isometric view of the extractor pivot pin of the bolt assembly shown in FIG. 1. FIG.

Referring to FIGS. 7, 1 & 3, the pivot pin 16 in the bolt assembly 2 extends through the transverse bore 67 of pin receiving lug 66 to couple the extractor 6 into the longitudinal opening 39 of the bolt 4. The extractor 6 contains detent means to secure the pivot pin 16 in the pivot pin receiving lug 66. Such detent means comprises detent ball 22, detent spring 24, compression lock 26 and a longitudinal bore 86 in extractor 6. The detent ball 22 is captured in the inner end 87 of bore 86 and the detent spring 24 is compressed against detent ball 22 by the compression lock 26. The pivot pin 16 has a central surface dimple 88 and when the pin 16 is correctly assembled in the extractor 6, the detent ball 22 engages the dimple 88 to secure the pin 16 in the extractor 6. Advantageously, the detent ball 22 is a ceramic ball and the detent spring 24 to bias such ball against the pivot pin 16 is a rubber spring.

Figure 8:
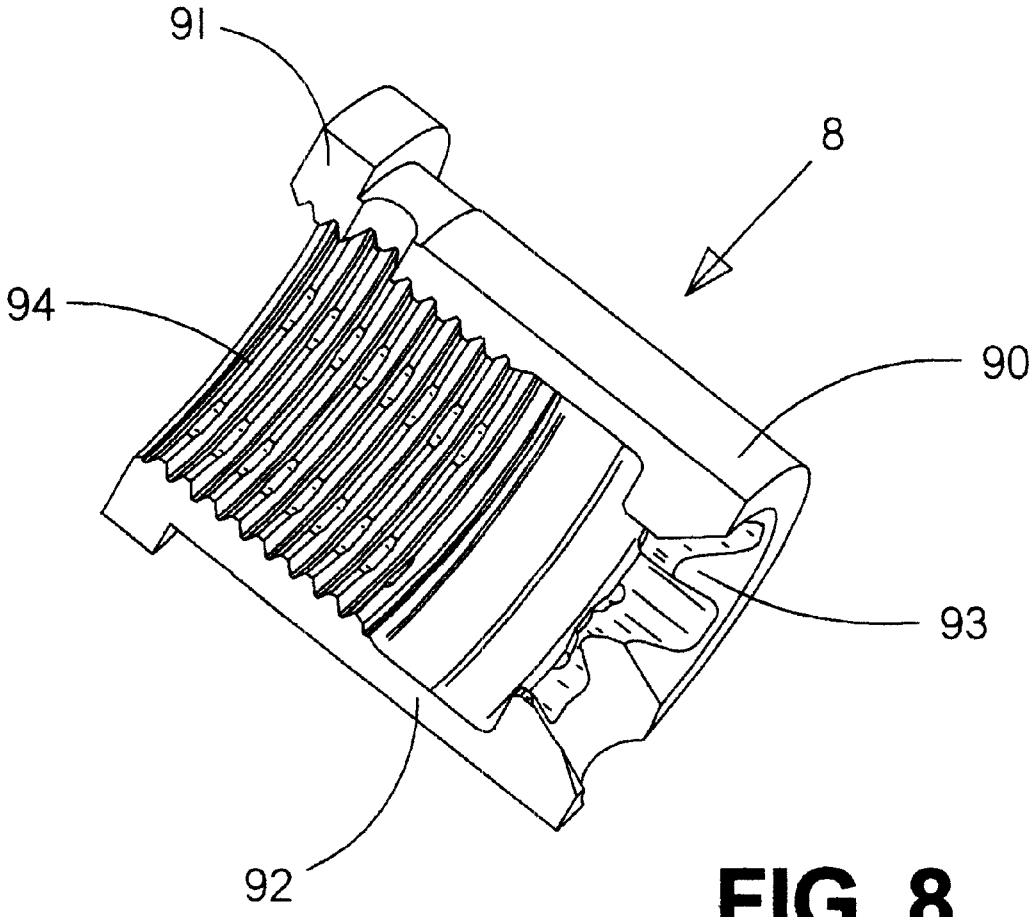
FIG. 8 is an enlarged lateral sectional view of the barrel extension of the bolt assembly taken on the line A—A of FIG. 1.

Referring to FIGS. 8, 1 and 2, the barrel extension 8 defined by a proximal end 90, a distal end 91, an integral central portion 92. A plurality of barrel extension lugs 9)3 extend integrally and radially inwardly of distal end 90 to operatively engage the bolt lugs 40. The distal end 91 has internal threads 94 to engage the external threads 95 on the rear end 18 of the firearm barrel 20.

Figure 9:
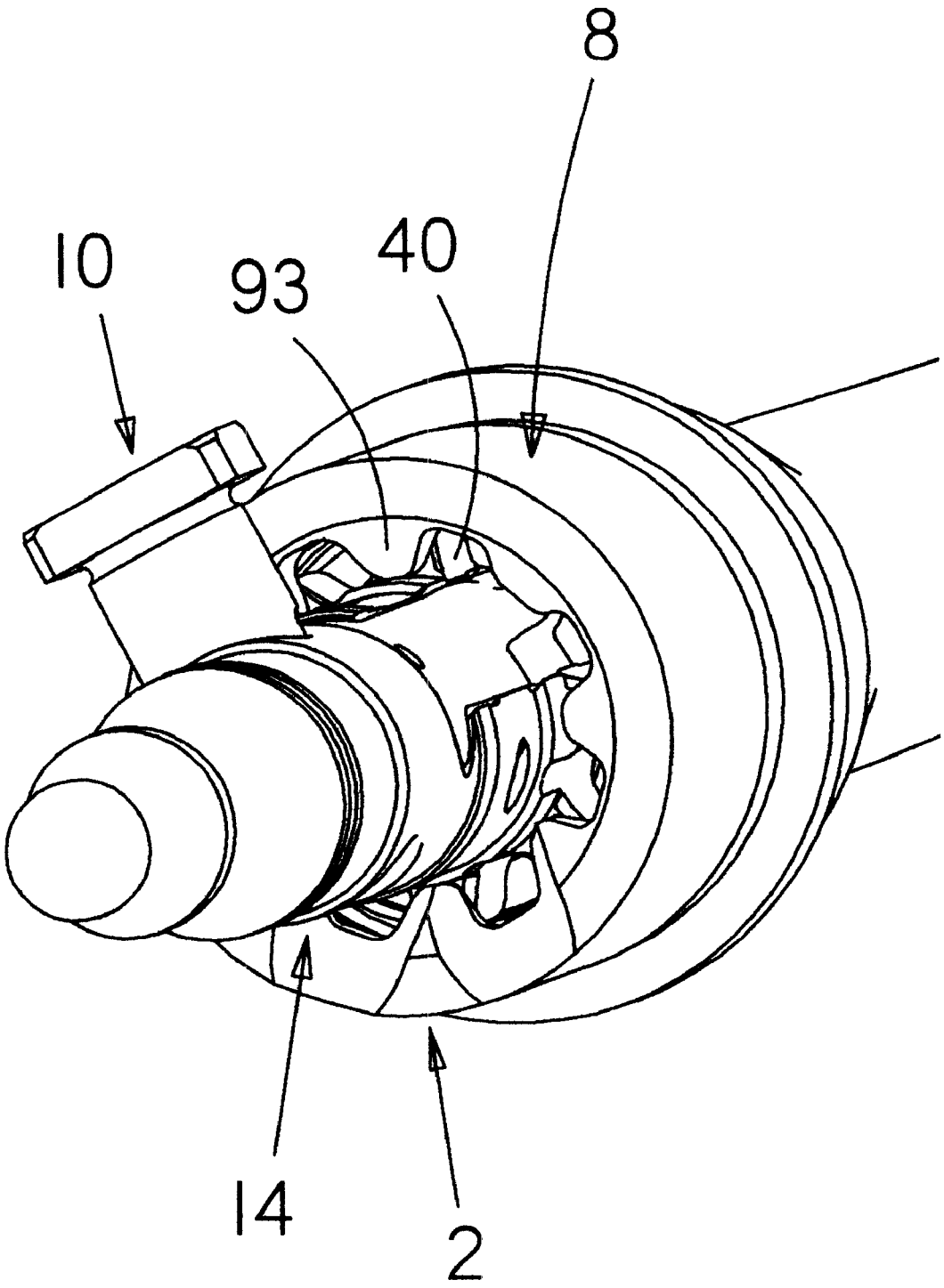
FIG. 9 is an enlarged isometric view of the new bolt assembly showing the bolt "locked" in the barrel extension.
Figure 10:
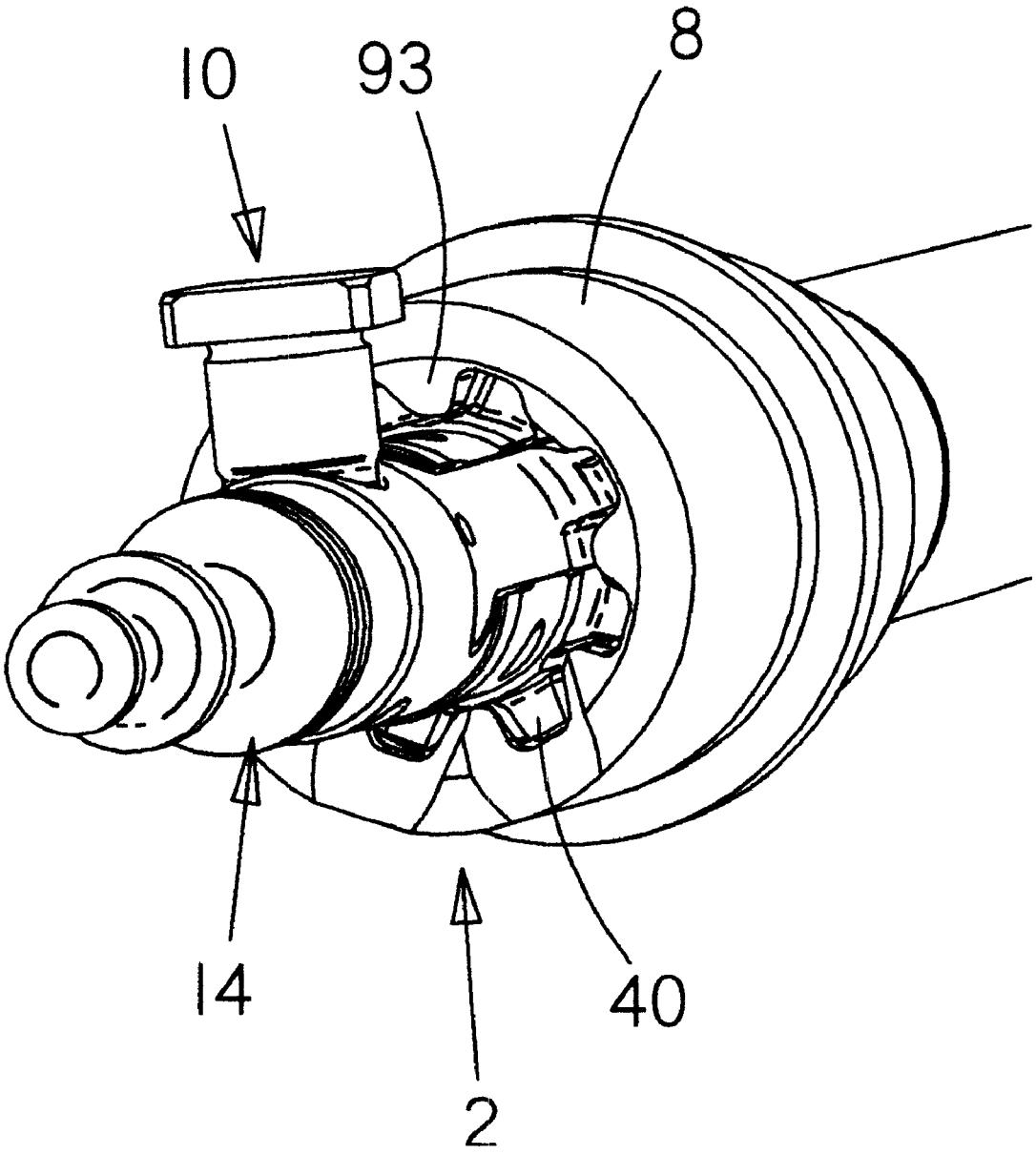
FIG. 10 is an enlarged isometric view of the new bolt assembly showing the bolt "unlocked" in the barrel extension.
Figure 11:
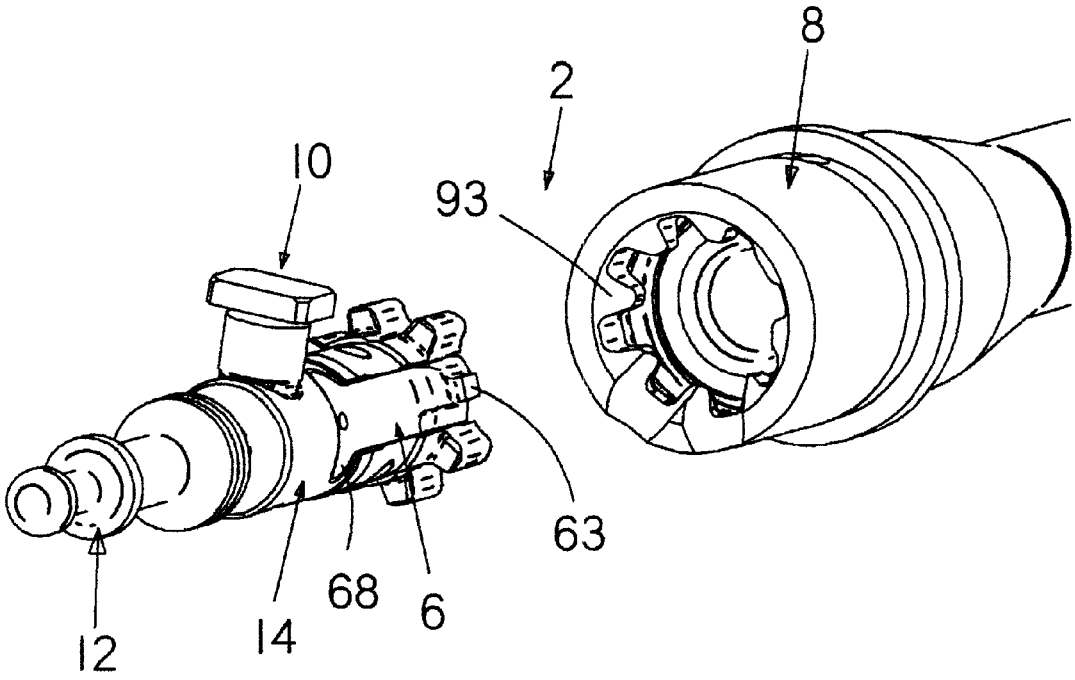
FIG. 11 is an enlarged isometric view of the new bolt assembly showing tile bolt in a "traveled rearward position" relative to the barrel extension.

Referring to FIG. 9, it shows how the bolt 14 is locked in the barrel extension 8 with the bolt lugs 40 captured by the barrel extension lugs 93 as the firearm is discharged. Then as shown in FIG. 10 as recoil of the firearm initially occurs, bolt 14 is rotated clockwise so the bolt lugs 40 are moved free of the barrel extension lugs 93 permitting the bolt 14 to be withdrawn from the barrel extension 8 as shown in FIG. 11 to permit a new cartridge (not shown) to be inserted.

The uniquely improved structuring of the bolt lugs 40 and barrel extension lugs 93 in accordance with the invention enable the new bolt assemblies 2 to perform these movements that inflict extreme stress on these lugs for a remarkable longer time without failure then prior know bolt assemblies of M4/M16 firearms.

What is claimed is:

1. In a bolt assembly for a firearm comprising:

(a) a bolt defined by a proximal end, a distal end terminating in a bolt face surrounded by an integral bolt head and an integral cylindrical portion disposed between said proximal end and said distal end along a longitudinal axis, said bolt head having a plurality of bolt lugs with walls extending integrally and radially outwardly thereof and a firing pin bore concentrically disposed in said bolt along said longitudinal axis, (b) an extractor defined by a proximal end, a distal end and an integral central section comprising a dependent pivot pin receiving lug, (c) a longitudinal opening in said integral cylindrical portion to receive said extractor, (d) a proximal ledge portion within said longitudinal opening, (e) an extractor pivot pin coupling said pivot pin receiving lug into said opening, (f) a pair of right and left springs that bias said extractor distal end toward said bolt face, (g) a firing pin reciprocally carried in said firing pin bore, (h) a cam pin carried in a transverse bore in said integral cylindrical portion and retained therein by said firing pin extending through a transverse bore in said cam pin and (i) a barrel extension defined by a proximal end, a distal end, an integral central portion and a plurality of barrel extension lugs extending integrally and radially inwardly of said barrel extension distal end to operatively engage said bolt lugs, the improvement wherein said proximal ledge portion comprises a right integral lateral lug portion defining a right partial bore that receives said right spring, a left integral lateral lug portion defining a left partial bore that receives said left spring, said right and left partial bores (a) are parallel to each other, (b) comprise proximal and distal vertical ramps and (c) are transversely spaced so they straddle said firing pin bore.

2. The bolt assembly of claim 1 comprising the additional improvement that said pivot pin receiving lug is positioned at the longitudinal center of the mass of said extractor.

3. The bolt assembly of claim 1 comprising the additional improvement that said extractor contains detent means to secure said extractor pivot pin in said pivot pin receiving lug.

4. The bolt assembly of claim 3 wherein said detent means comprises a ceramic ball and captive spring means to bias said ball against said extractor pivot pin.

5. The bolt assembly of claim 4 where said spring means is a rubber spring carried in a longitudinal bore in said extractor.

6. The bolt assembly of claim 1 comprising the additional improvement that said walls of said bolt lugs are angled tangent to full radius fillets joining adjacent bolt lugs.

7. The bolt assembly of claim 1 comprising the additional improvement that said bolt head junction with said integral cylindrical portion is rebate filleted.

8. The bolt assembly of claim 1 comprising the additional improvement that said bolt face has a circular periphery.

9. The bolt assembly of claim 1 comprising the additional improvement that the walls of said barrel extension lugs are angled tangent to substantial radius fillets joining adjacent barrel extension lugs.

10. The bolt assembly of claim 1 comprising the additional improvement that said firing pin has a diameter of between 0.116 and 0.117 inches along its portion that extends through said cam pin.

11. In a bolt assembly for a firearm comprising:

(a) a bolt defined by a proximal end, a distal end terminating in a bolt face surrounded by an integral bolt head and an integral cylindrical portion disposed between said proximal end and said distal end along a longitudinal axis, said bolt head having a plurality of bolt lugs with walls extending integrally and radially outwardly thereof and a firing pin bore concentrically disposed in said bolt along said longitudinal axis, (b) an extractor defined by a proximal end, a distal end and an integral central section comprising a dependent pivot pin receiving lug, (c) a longitudinal opening in said integral cylindrical portion to receive said extractor, (d) a proximal ledge portion within said longitudinal opening, (e) an extractor pivot pin coupling said pivot pin receiving lug into said opening, (f) a pair of right and left springs that bias said extractor distal end toward said bolt face, (g) a firing pin reciprocally carried in said firing pin bore, (h) a cam pin carried in a transverse bore in said integral cylindrical portion and retained therein by said firing: pin extending through a transverse bore in said cam pin and (i) a barrel extension defined by a proximal end, a distal end, an integral central proportionally disposed and a plurality of barrel extension lugs extending integrally and radially inwardly of said barrel extension distal end to operatively engage said bolt lugs, the improvements wherein:

(A), said proximal ledge portion comprises a right integral lateral lug portion defining a right partial bore that receives said right spring, a left integral lateral lug portion defining a left partial bore that receives said left spring, said right and left partial bores (a) are parallel to each other, (b) comprise proximal and distal vertical ramps and (c) are transversely spaced so they straddle said firing pin bore.

(B) said pivot pin receiving lug is positioned at the longitudinal center of the mass of said extractor and (C) said walls of said bolt lugs are angled tangent to full radius fillets joining adjacent bolt lugs.

12. The bolt assembly of claim 11 comprising the additional improvement that said firing pin has a diameter of between 0.116 and 0.117 inches along its portion that extends through said cam pin.

* * * * *